US008905454B2

(12) United States Patent
Stock et al.

(10) Patent No.: US 8,905,454 B2
(45) Date of Patent: Dec. 9, 2014

(54) CASKET HANDLING SYSTEM

(75) Inventors: Dennis K. Stock, Cincinnati, OH (US); Chadwick D. Fox, Cincinnati, OH (US)

(73) Assignee: FYDA Freightliner Cincinnati, Inc., Cincinnati, OH (US)

( * ) Notice: Subject to any disclaimer, the term of this patent is extended or adjusted under 35 U.S.C. 154(b) by 283 days.

(21) Appl. No.: 13/463,578

(22) Filed: May 3, 2012

(65) Prior Publication Data

US 2012/0282076 A1 Nov. 8, 2012

Related U.S. Application Data

(60) Provisional application No. 61/483,117, filed on May 6, 2011.

(51) Int. Cl.
*A61G 21/00* (2006.01)

(52) U.S. Cl.
CPC ..... *A61G 21/00* (2013.01)
USPC ..... 296/18; 414/541

(58) Field of Classification Search
CPC ..... A61G 21/00
USPC ..... 296/16, 17, 18; 410/26, 28.1, 29.1; 414/469, 477, 478, 480, 495, 498, 501, 414/540, 541, 545, 589, 679
See application file for complete search history.

(56) References Cited

U.S. PATENT DOCUMENTS

| | | | | | |
|---|---|---|---|---|---|
| 182,429 | A | * | 9/1876 | Foust | 414/522 |
| 420,605 | A | * | 2/1890 | McCauley | 414/522 |
| 1,204,271 | A | * | 11/1916 | Greene | 414/522 |
| 1,275,840 | A | * | 8/1918 | Budde | 414/522 |
| 1,909,674 | A | * | 5/1933 | Harris | 296/16 |
| 1,925,964 | A | | 9/1933 | Koppe | |
| 1,971,991 | A | * | 8/1934 | Robertson | 414/522 |
| 2,146,203 | A | * | 2/1939 | Demarest | 414/495 |
| 2,654,633 | A | * | 10/1953 | Runkle et al. | 296/16 |
| 3,019,920 | A | * | 2/1962 | Hillenbrand et al. | 414/531 |
| 3,372,819 | A | | 3/1968 | Kellogg | |
| 3,718,227 | A | | 2/1973 | Swift | |
| 4,902,188 | A | | 2/1990 | Page | |
| 5,011,362 | A | * | 4/1991 | Pijanowski | 414/480 |
| 5,080,541 | A | | 1/1992 | Andre | |
| 5,328,320 | A | | 7/1994 | Farrow et al. | |
| 5,531,557 | A | | 7/1996 | Springer | |
| 5,702,222 | A | | 12/1997 | Rosen | |
| 5,797,712 | A | | 8/1998 | Gearin et al. | |
| 5,853,280 | A | | 12/1998 | Lohr | |
| 5,879,122 | A | | 3/1999 | Voelzke | |

(Continued)

FOREIGN PATENT DOCUMENTS

| | | | | | |
|---|---|---|---|---|---|
| DE | 476489 | C | * | 5/1929 | A61G 21/00 |
| DE | 20000835 | U1 | * | 6/2000 | A61G 21/00 |

(Continued)

*Primary Examiner* — Glenn Dayoan
*Assistant Examiner* — Paul Chenevert
(74) *Attorney, Agent, or Firm* — Roth Blair

(57) ABSTRACT

A multi-tiered casket handling system is configured to preferably be placed in a vehicle. Because the casket handling system admits to adjustability in its mounting, a wide range of vehicles can be used. Further, because the casket handling system has a system for tilting the rear upper tier and powered movement of caskets, the system is capable of handling greater numbers of caskets than is possible with conventional systems, thereby taking full advantage of larger vehicles.

16 Claims, 15 Drawing Sheets

(56) References Cited

U.S. PATENT DOCUMENTS

| | | | | |
|---|---|---|---|---|
| 5,938,382 | A | 8/1999 | Andre et al. | |
| 6,231,294 | B1 | 5/2001 | Young et al. | |
| 6,241,452 | B1 | 6/2001 | Eekhoff | |
| 6,447,226 | B1 | 9/2002 | Andre | |
| 6,450,742 | B1 | 9/2002 | Jenkins et al. | |
| 6,547,509 | B1 | 4/2003 | Edmo | |
| 6,758,648 | B1 | 7/2004 | Eekhoff et al. | |
| 6,932,401 | B1 | 8/2005 | Eekhoff et al. | |
| 7,014,237 | B1 | 3/2006 | Eekhoff et al. | |
| 7,033,128 | B2 * | 4/2006 | Poindexter | 414/544 |
| 7,316,437 | B2 * | 1/2008 | Sinclair | 296/16 |
| 7,575,402 | B2 | 8/2009 | Boydstun, IV et al. | |
| 8,366,167 | B2 * | 2/2013 | Sartin et al. | 296/24.38 |
| 2002/0051692 | A1 | 5/2002 | Cottrell | |

FOREIGN PATENT DOCUMENTS

| | | | | |
|---|---|---|---|---|
| DE | 102007049179 | B3 * | 12/2008 | A61G 21/00 |
| DE | 102010027409 | A1 * | 1/2011 | A61G 21/00 |
| DE | 202011050603 | U1 * | 12/2011 | A61G 21/00 |
| DE | 202013103256 | U1 * | 9/2013 | B60P 1/44 |
| FR | 2856588 | A1 * | 12/2004 | A61G 21/00 |

* cited by examiner 242
24
245
246
243
241
247
248
14(a)
137
20

24
241
14(a)
137
20
14(b)

242
241
243

CASKET HANDLING SYSTEM

PRIORITY INFORMATION

The present invention claims priority to U.S. Provisional Patent Application No. 61/483,117 filed on May 6, 2011.

FIELD OF THE INVENTION

The present invention relates generally to a system for handling, transporting, and storing caskets. In particular, the present system is directed to the accommodation of increased numbers of caskets in a wide variety of vehicle types.

BACKGROUND ART

Handling caskets and arranging them for transport in a moderately sized vehicle such as a van, has traditionally been a complex, and often difficult endeavor. Firstly, machinery for handling and storing heavy caskets has to be adapted to the interior of transport vehicles such as vans. The weight of the caskets and the supports necessary to hold them often put a substantial strain on the sidewalls and the bed of the vehicle. Multiple tiers of caskets also add additional stress to such arrangements. Moving the caskets in and out of a vehicle so equipped is often a very difficult endeavor leading to the danger of damage to the vehicle and to the expensive caskets. This is especially crucial when dealing with lightweight vans, which are very commonly used for a wide range of transport missions.

One known transport arrangement for holding caskets in a van is disclosed in U.S. Pat. No. 6,932,401 to Eekhoff, et al. This arrangement uses horizontal supports to hold two tiers of caskets. Each tier holds two caskets arranged next to each other lengthwise. The overall system is adapted for use in vans and similar vehicles.

In order to adapt the Eekhoff, et al. support structure to a van, brackets are used to support the lower tier from the bed or floor of the vehicle. The upper tier is supported by forward upright supports at the head or the front of the upper tier. The other half of the upper tier is supported by lift arms which are moved by either an electric or a hydraulic motivating system, which moves the upper tier up and down as facilitated by pivoting structures connecting the upper tier and the upright supports.

A disadvantage of the Eekhoff, et al. system is that the overall structure can support only a single row of two caskets on the upper tier. Further, the lower tier of the Eekhoff, et al. system is designed only for a single row of two caskets. Also, the Eekhoff, et al. system depends upon the two upright supports pivotally holding the front edge of the upper tier. The lower tier is independently held by connections to only the vehicle bed. Likewise, the upright supports also rely only upon the vehicle bed for support and stability.

The limited stability and capacity of the Eekhoff, et al. system appears to be suitable for relatively small vehicles such as small vans. However, the larger capacities available with larger vehicles cannot be exploited using the Eekhoff, et al. system. For example, in many cases, more than four caskets need to be carried in a single vehicle, when a vehicle has suitable cargo space to do so.

The use of the Eekhoff, et al. system, as well as other conventional systems, does not permit exploitation of increased vehicle capacity. Simply increasing the size of the Eekhoff, et al., system to match increased vehicle cargo capacities would result in an arrangement that is unstable and still incapable of handling a greater number of caskets.

Further, handling caskets within the confines of a vehicle can be very awkward with conventional systems. This is one of the reasons that conventional casket storage systems are limited in capacity. The walls of the vehicle often severely limit any access to the caskets being stored. Without easy access, handling the caskets can be very difficult, and even dangerous.

Accordingly, there is a need for a casket handling system that can exploit increased vehicle sizes while maintaining stability when handling an increased number of caskets. Such a system would be safe and easily operated so that the increased number of caskets could be handled without increased difficulty. Chances of damage to the caskets would also be minimized by the new system. Flexibility for installing the new system would be increased, adapting to different vehicle sizes and types.

SUMMARY OF THE INVENTION

Accordingly, it is a primary object of the present invention to provide an improved casket handling system with increased capacity over systems in the conventional art.

It is a further object of the present invention to provide an improved casket handling system which is compact in configuration.

It is another object of the present invention to provide a casket handling system that can be accommodated by a wide range of vehicles.

It is an additional object of the present invention to provide a casket handling system that can be easily shifted from one vehicle to another.

It is still a further object of the present invention to provide a casket handling system that can be adjusted so as to provide the best support in a wide range of different vehicles.

It is again another object of the present invention to provide a casket handling system that can be expanded to accommodate larger capacities for larger vehicles.

It is still an additional object of the present invention to provide a casket handling system that better guards against damage to the caskets during all phases of transport.

It is yet a further object of the present invention to provide an improved casket handling system that can fully exploit large vehicle cargo spaces.

It is again a further object of the present invention to provide a casket handling system that provides a stable loading and storage platform in a variety of different environments.

It is again another object of the present invention to provide a casket handling system in which multiple rows of caskets can be easily handled using only rear access to the system.

These and other goals and objects of the present invention are found in a multi-tiered casket handling system having an accessible adjustable rear section and a fixed front section of at least two tiers. Each of the front sections and the rear section contains at least one upper tier and one lower tier. Each tier accommodates two rows, each row capable of holding at least two caskets. Each tier has at least one movable tray for transporting caskets between the front section and the rear section.

Another embodiment is directed to a method of handling caskets on a multi-tiered handling and storage device having upper and lower tiers, each with front and rear sections. The method includes the steps of placing a casket on a lower tier, and then operating a motorized tray to move the casket between the rear section and the front section of that tier.

A further embodiment of the present invention includes a method of handling caskets on a multi-tiered casket handling and storage device having upper and lower tiers each with front and rear sections. The method includes the steps of operating a power system to lower the upper tier downward. Then a casket is placed on the rear section of the lowered upper tier. Finally, the power system is operated to raise the casket and the upper tier.

DETAILED DESCRIPTION OF THE PREFERRED EMBODIMENT

Figure 1:
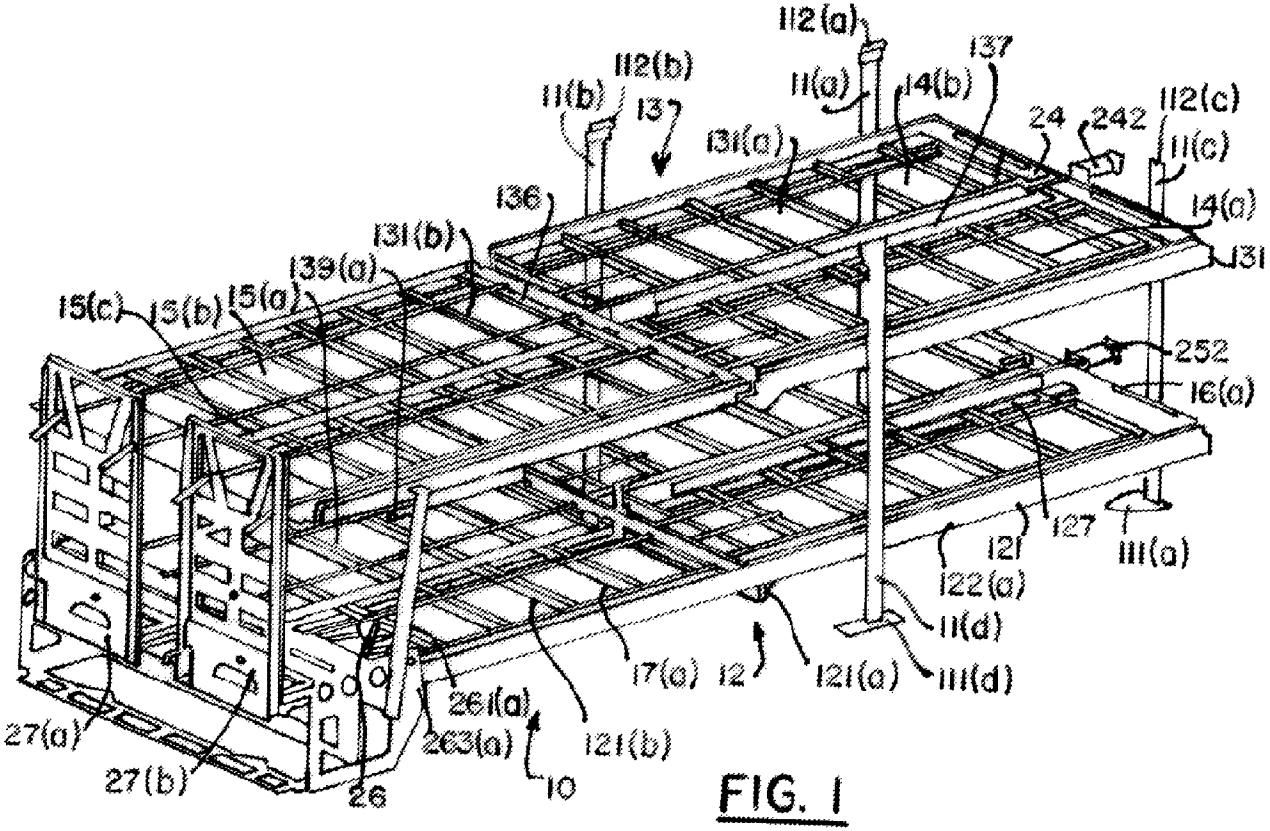
FIG. 1 is a perspective view of one embodiment of the present invention in a closed stored alignment.

The present application is a casket handling system 10, which is meant to be placed into a vehicle (not shown) having interior sidewalls (not shown) and an interior bed or floor. Preferably, the casket handling system 10 of the present invention is meant to be secured to both the sidewalls and the vehicle bed or floor 3. However, the present invention 10 can be used outside of a vehicle in constrained spaces where multiple rows of caskets (not shown) would be desirable.

The purpose of the present inventive casket handling system 10 is to fully utilize all available space in a variety of different vehicles, or other constrained environments. In particular, this is done by facilitating the stacking of multiple rows of caskets, both vertically and horizontally along the length of the available cargo compartment. The present invention 10 facilitates the safe and easy stacking of caskets in multiple rows on multiple tiers by using the techniques described infra.

In vehicles, stable handling and storage is facilitated by connecting the casket handling system 10 to the floor, and the sidewalls (not shown) of the vehicle. Vertical supports 11(*a*)-11(*d*) are placed as needed in order to facilitate a stable connection between the casket handling system 10 and the vehicle. The vertical supports 11(*a*)-11(*d*) also facilitate a stable connection between the upper tier 13 and the lower tier 12. This arrangement maintains a more reliable structural connection arrangement between the two tiers 12, 13 and the interior of the vehicle cargo compartment (defined by the sidewalls and the floor). The vertical supports 11(*a*)-11(*d*) are placed in positions that are most advantageous to securing the casket handling system 10 to the interior of the vehicle.

While four vertical supports 11(*a*)-11(*d*) are depicted with three at the sides of upper and lower support frames 131, 121, respectively, and one at the head or front of the upper and lower support frames (131, 121), the present invention is not confined to this arrangement. Rather, as many vertical supports 11(*a* . . . ) can be used as is necessary for securing the casket handling system 10 to its environment (such as a vehicle).

Depending upon the environment, the present invention can have more than two tiers, can accommodate more than two rows of caskets on each tier, and could contain more than two caskets in each row. However, for purposes of explaining the invention, the preferred embodiment depicted in the drawings will be relied upon exclusively. Nonetheless, those skilled in this particular technology will be able to adapt the present invention for using more tiers and more rows of caskets than depicted in the drawings using standard adaptations once the concepts of the present invention are understood.

Figure 2:
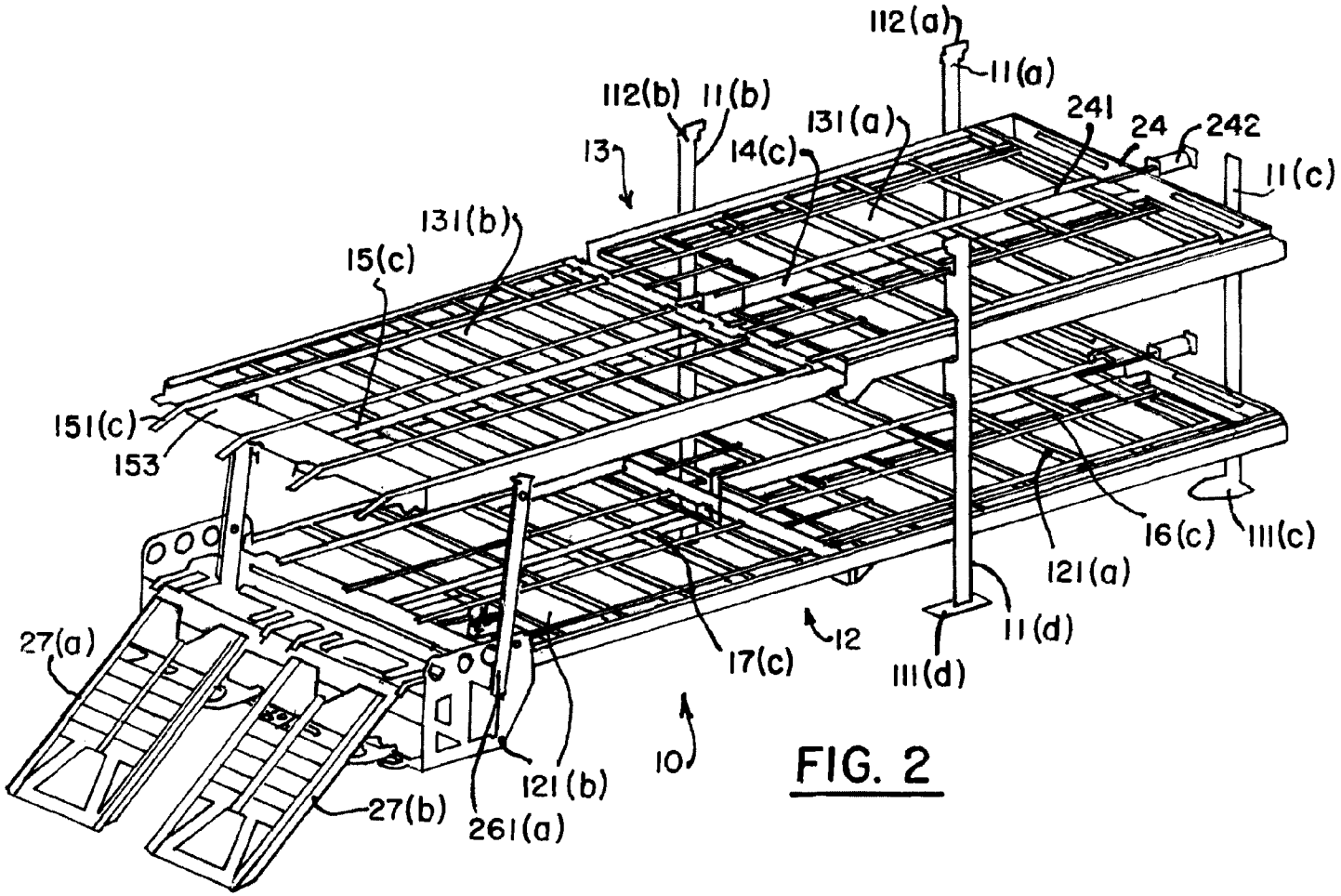
FIG. 2 is a perspective view of the present invention with the loading ramps deployed for adding or removing caskets.
Figure 3:
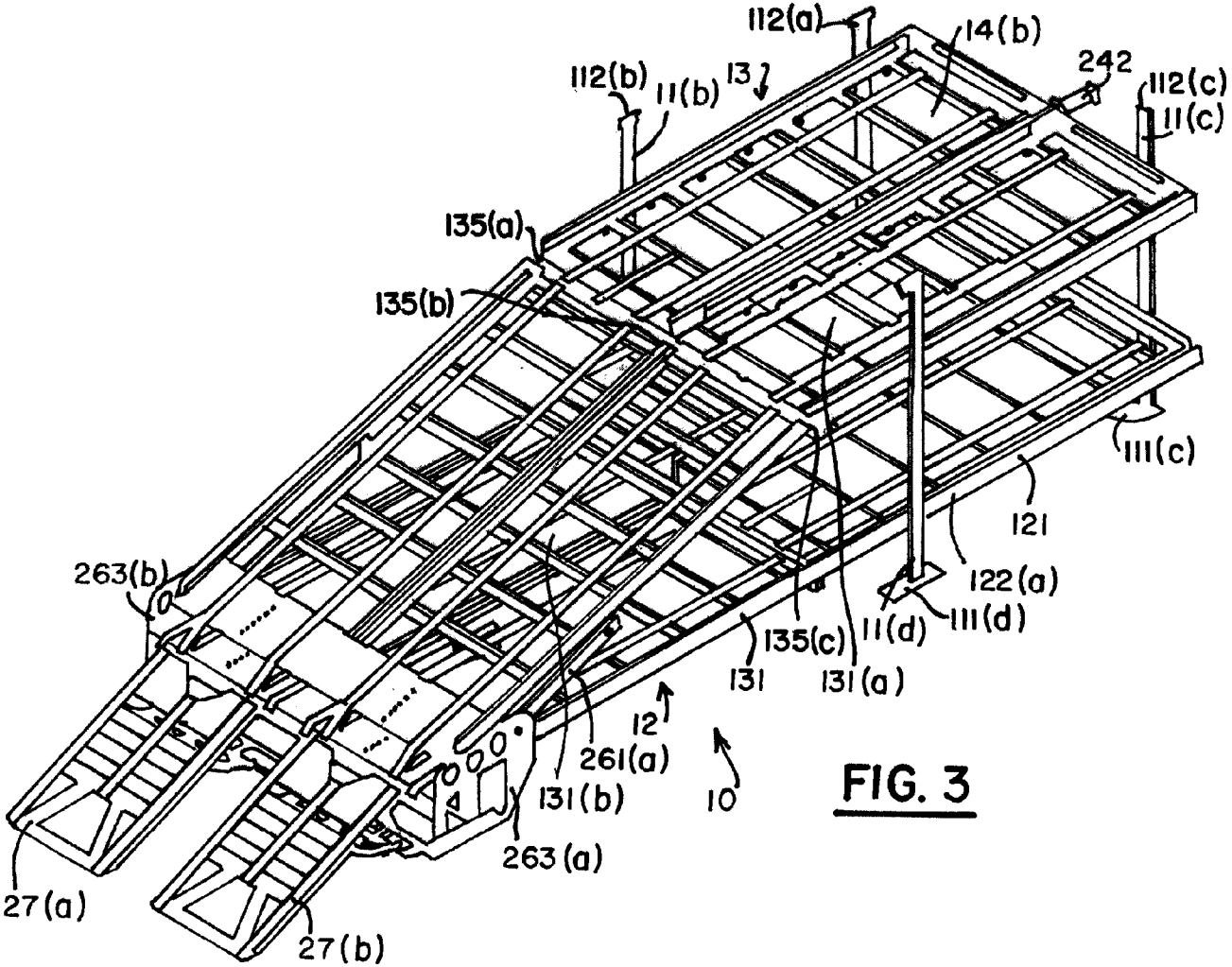
FIG. 3 is a perspective top view of the present invention with the rear row section of the upper tier lowered for adding or removing caskets to the upper tier.

The top perspective views of FIGS. 1-3 are based upon photographs taken of a first preferred embodiment of the present invention 10 located outside of a vehicle (or other storage/handling environment for which the present invention is adapted). In this embodiment, there are only two tiers, lower tier 12 and upper tier 13. Each tier is capable of holding two rows of two caskets each (not shown). The embodiment of FIG. 1 is depicted in the "stowed" or closed position in which loading ramps 27(*a*), 27(*b*) are held in a raised position and the rear section 131(*b*) of the upper support frame 131 is in the raised position, suitable for storing or transporting two rows of two caskets (not shown) each.

In FIG. 2, the ramps 27(*a*), 27(*b*) are depicted in the lowered position to facilitate the removal or loading of caskets (not shown) on the lower tier 12. In this position, the caskets (not shown) can be easily placed on the rear section 121(*b*) of lower support frame 121 of lower tier 12. Conceivably, caskets (not shown) in the rear section 121(*b*) of the lower tier 12 could be pushed forward to the front section 121(*a*). However, this might entail some degree of difficulty with heavy caskets if done manually, especially in tight quarters such as a small cargo compartment in a vehicle. Also, such an effort might entail a risk of damage to an expensive and well-finished casket. The present invention offers a suitable alternative as will be described infra.

In FIG. 3, the rear section 131(*b*) of upper tier 13 is depicted in a lowered position so that the rear end of rear section 131(*b*) is positioned proximate the tops of lowered ramps 27(*a*), 27(*b*). In this position, caskets (not shown) on the rear section 131(*b*) can be slid either on or off rear section 131(*b*) using ramps 27(*a*), 27(*b*). Once the caskets are loaded on the rear section 131(*b*), then the rear end of the rear section 131(*b*) is raised by deck lift system 26 using sliding lift arms 261(*a*), 261(*b*) as will be described infra. The structure, by which the rear section 131(*b*) of upper tier 13 is lowered, as depicted in FIG. 3, is further described infra in connection with the complete structure of casket handling system 10.

Figure 4:
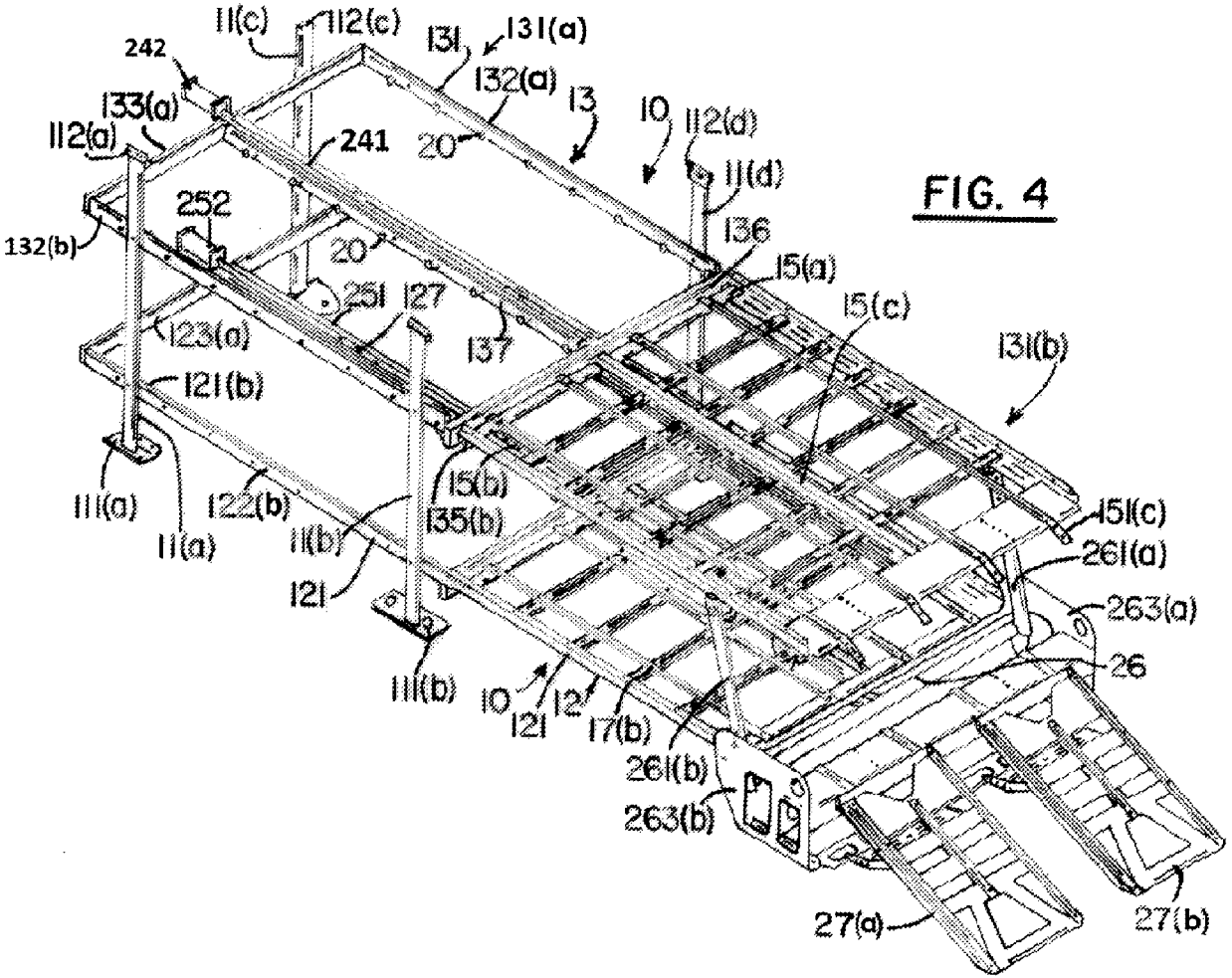
FIG. 4 is a top perspective view of the present invention with the upper and lower front sliding trays moved to the rear row sections of the structure to upload or receive caskets.

Many of the details of casket handling system 10 are better depicted in the perspective view of FIG. 4. In this drawing, ramps 27(*a*), 27(*b*) are depicted in the lowered position. However, the rear section 131(*b*) of upper tier 13 in the raised position. Upper sliding trays 14(*a*), 14(*b*) have been removed to clearly depict rear section 131 (*b*) of upper tier 13 in the perspective view of FIG. 4.

The depiction of FIG. 4 demonstrates that there is no bed for front sections 121(*a*) and 131(*a*) (but only a peripheral framework) supporting the upper sliding trays 14(*a*), 14(*b*), as they are depicted in FIG. 3. However, under some circumstances, it may be desirable to place a bed of some sort of material under either the lower front row 121(*a*), as depicted in FIG. 2, or the upper front row 131(*a*). Any type of bed configuration that is considered appropriate can be used. However, the bed is not crucial since the upper front sliding trays 14(*a*), 14(*b*) and the lower front sliding trays 16(*a*), 16(*b*) ride on roller bearings 20(*a*), (*b*), (*c*) . . . and 21(*a*), (*b*), (*c*) . . . .

Figure 7:
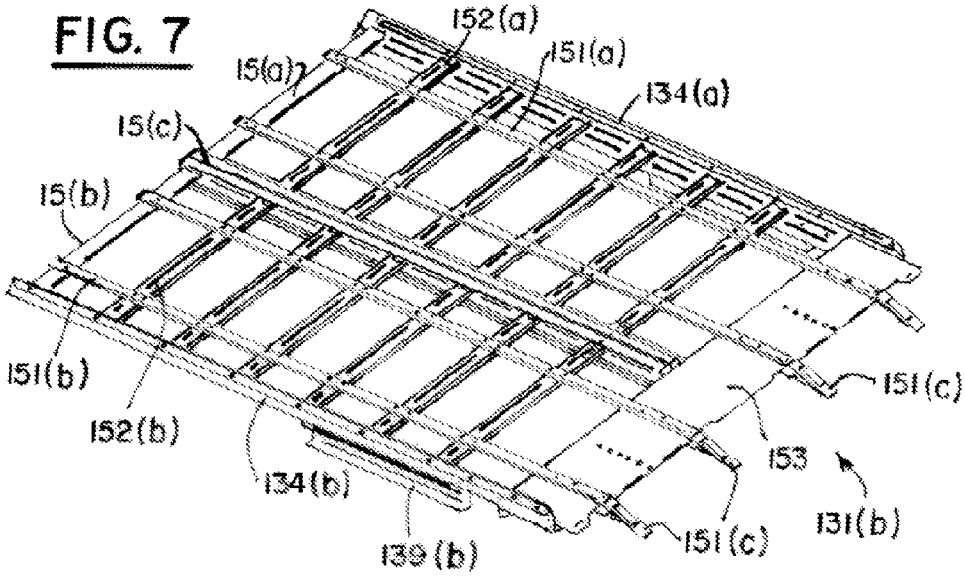
FIG. 7 is a top perspective view of the structure of the upper rear deck.

With both the upper front sliding trays 14(*a*), 14(*b*) and the lower front sliding trays 16(*a*), 16(*b*) from the depiction of FIG. 4, both the upper rear section 131(*b*) and the lower rear section 121(*b*) are clearly depicted. Each of these sections is filled with a framework of perpendicular struts, 151(*a*), 152 (*a*), 151(*b*), 152(*b*) for the upper rear deck, and 171(*a*), 172 (*a*), 171(*b*), 172(*b*) for the lower rear decks 17(*a*), 17(*b*). The upper rear decks 15(*a*), 15(*b*) are depicted in FIG. 7 to more clearly illustrate the overall structure found in FIG. 4. The lower rear decks 17(*a*), 17(*b*) closely resemble the upper rear decks 15(*a*), 15(*b*).

Figure 11:
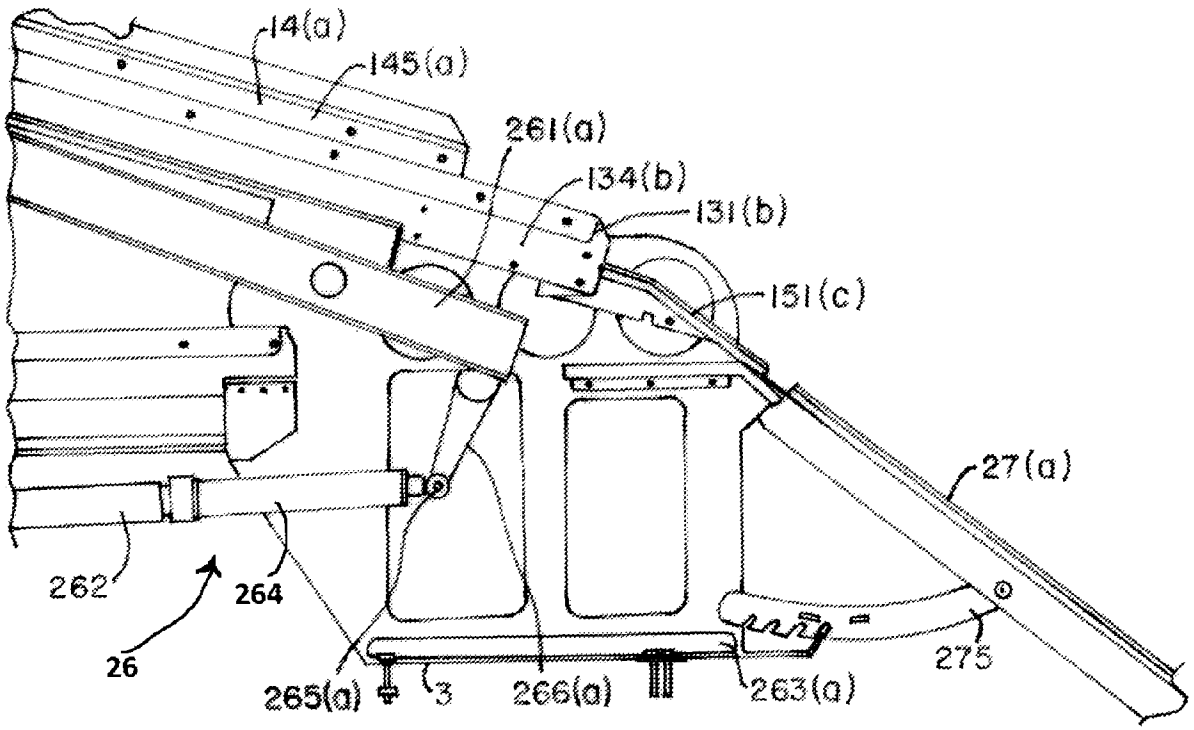
FIG. 11 is a side detailed view of the bottom of the present invention deployed for adding or removing caskets, and in which the upper sliding tray has been moved onto the upper rear row section.

One difference between the upper and lower rear decks 15(*a*), 15(*b*) and 17(*a*), and 17(*b*), respectively, resides in the slide extensions 151(*c*) included on the upper rear decks 15(*a*), 15(*b*). These slide extensions 151(*c*) help facilitate easy movement of the caskets from the upper rear decks 15(*a*), 15(*b*) to the loading ramps 27(*a*), 27(*b*). The position of the slide extensions is best depicted in FIG. 11.

Figure 8:
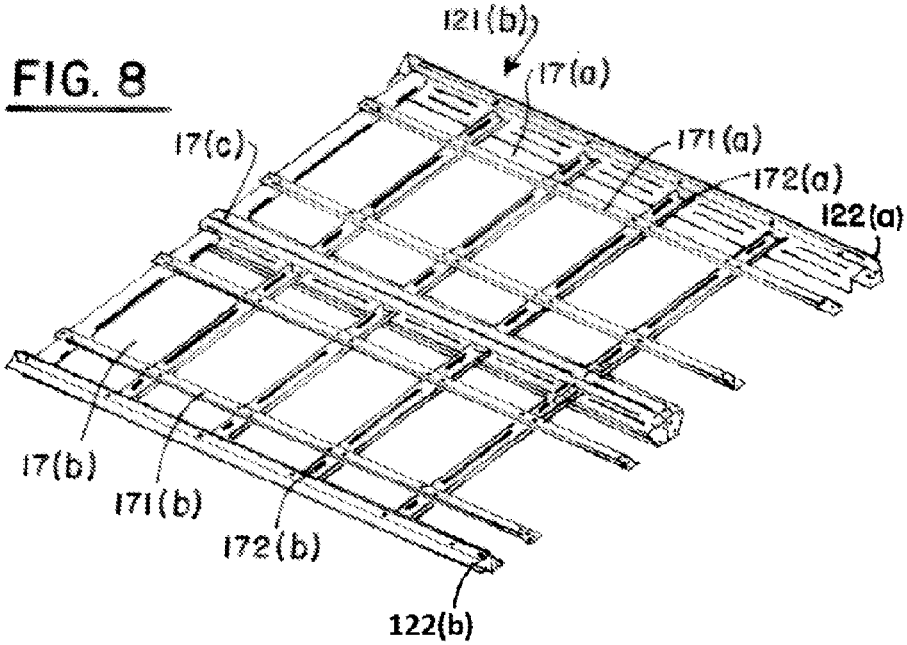
FIG. 8 is a top perspective view of the bottom rear deck.

To contrast the upper rear decks 15(*a*), 15(*b*) with the lower rear decks 17(*a*), 17(*b*) a comparison can be made between FIG. 8, (lower rear decks 17(*a*), 17(*b*)) and FIG. 7, (upper rear decks 15(*a*), 15(*b*)). One distinction between these structures is the use of cross-piece 153 on the upper rear decks 15(*a*), 15(*b*). This structure helps to stabilize the ends of the struts and the slide extensions 151(*c*) to create a more stabile path for the caskets to follow when being loaded or unloaded. Both the upper rear decks 15(*a*), 15(*b*) are joined together by longitudinal junction beam 15(*c*). Likewise, both of the lower rear decks 17(*a*), 17(*b*) are joined together by a longitudinal junction beam 17(*c*). In both cases, this is done to facilitate the stability of the combined deck structures. This is important since both decks must support the upper and lower sliding trays 14(*a*), 14(*b*) and 16(*a*), 16(*b*), respectively. Accordingly, a stable rear deck structure for both tiers 12, 13 is crucial to an effective design.

It should be noted that the terminology "rear" and "front" is used to describe the two sections of both the lower tier 12 and the upper tier 13. This terminology is used to easily identify position and to maintain conformity with respect to the various parts of the casket handling system 10 within a vehicle. This is done only for ease of identification of different parts of the casket handling system 10, and is not limiting with respect to the ultimate deployment of the casket handling system 10. For example, the casket handling system 10 could be placed in a fixed installation rather than a vehicle. The terminology "rear" is simply an easy way of identifying the portion of the lower and upper tiers 12, 13 at which caskets are added or removed from casket handling system 10.

The vertical supports or legs 11(*a*)-11(*d*) (as depicted in FIG. 1-4) can be of any number and any placement that is most appropriate for supporting a particular configuration of lower and upper tiers 12, 13 together in a rigid, stable structure. For purposes of the first preferred embodiment, as depicted in FIGS. 1-3, there are two vertical supports on one longitudinal side of upper and lower support frames 131, 121, a third vertical support on the opposite longitudinal side, and a single vertical support at the front lateral portion of the structure casket handling system 10.

Besides the placement of the vertical supports 11(*a*)-11(*d*), further flexibility in the arrangement for attaching the casket handling system 10 to its environment is provided by floor connection pads 111(*a*)-111(*d*) and sidewall connection pads 112(*a*)-112(*d*). These connection pads can include appropriate configurations for connecting to a wide variety of different surfaces. Usually, apertures for screws, bolts and the like are adequate for providing the necessary connections between the casket handling system 10 and its surrounding environment, whether that environment is the interior of a vehicle, a wooden deck, or other type of structure.

A key advantage of the vertical support arrangement of the present invention 10 are sidewall connection pads 112(*a*)-112 (*d*), which can be used to attach the vertical supports 11(*a*)-11(*d*) to the side walls of the enclosing vehicle. Multiple attachments of the casket handling system 10 to both the bed of the vehicle and the sidewalls render a far more stable structure, thereby reducing the chances of the caskets shifting and being damaged. Reliance upon the vehicle walls (not shown), as well as the bed or floor of the vehicle, provides a distinct advantage to the present invention.

The lower support frame 121 of lower tier 12 is designated as having two sections: front section 121(*a*); and, rear section 121(*b*). It should be noted that the upper tier 13 has an upper support frame 131, which is divided into two sections longitudinally. This is not true for the lower tier 12. Rather, the lower tier 12 has a lower support frame 121 that is constituted by two uninterrupted continuous, parallel longitudinal beams 122(*a*), 122(*b*) which run the entire length of the lower tier 12, and are connected by lower front beam 123(*a*). The continuous, parallel longitudinal beams 122(*a*), 122(*b*) provide a great deal of stability. As such, the lower support frame 121 is a unitary structure. This is very important to the structural integrity and operation of the present invention.

The designation of a lower front section 121(*a*), and lower rear section 121(*b*) is merely a matter of convenience for naming the sections on which the lower front sliding trays 16(*a*), 16(*b*) are normally located. This designation is used for describing the loading and unloading operation using the lower sliding trays 16(*a*), 16(*b*), as well as the upper sliding trays 14(*a*), 14(*b*).

In contrast, upper tier 13 consists of two separate structures, upper front section 131(*a*) and upper rear section 131 (*b*). The upper front section 131(*a*) is rigidly connected (using upper parallel front longitudinal beams 132(*a*), 132(*b*)) to the lower support frame 121 by means of vertical supports 11(*a*)-11(*d*). The upper parallel front longitudinal beams 132(*a*), 132(*b*) are connected in front by an upper front beam 133(*a*).

A vertical support 11(*c*) connects the upper front beam 133(*a*) to the lower front beam 123(*a*).

However, the upper rear section 131(*b*) uses separate upper, parallel rear longitudinal beams 134(*a*), 134(*b*). These are connected to the upper parallel front longitudinal beams 132(*a*), 132(*b*) via a hinge connection on upper lateral pivot beam 136, as described infra. Accordingly, the upper parallel front longitudinal beams 132(*a*), 132(*b*) are not the same as the upper parallel rear longitudinal beams 134(*a*), 134(*b*). This is in distinct contrast to the unitary longitudinal beam structure of the lower support frame 121.

It should be clear from FIG. 4 that front section 121(*a*) of the lower tier 12 is connected to the front section 131(*a*) of upper tier 13 using vertical supports 11(*a*)-11(*d*). The connection between the upper front row section 131(*a*) and the upper rear section 131(*b*) is a pivoting connection which is effected by upper lateral pivot beam 136. This allows the upper rear decks, 15(*a*), 15(*b*) to be easily and reliably tilted downward to allow loading or unloading of caskets to the upper tier 13. In conjunction with the pivoting connection effected by upper lateral pivot beam 136, the upper rear decks of upper rear section 131(*b*) is raised and lowered by sliding lifts arms 261(*a*), 261(*b*).

The sliding lift arms 261(*a*), 261(*b*) are attached to support frames 263(*a*), 263(*b*), and are activated by deck lift system 26, including push arm 264 which is driven by either electric or hydraulic motivator 262 (as depicted in FIG. 11) in a conventional manner. The sliding lift arms 261(*a*), 261(*b*) are connected to upper rear section 131(*b*) by means of holding tracks 139(*a*), 139(*b*) mounted on the upper rear parallel longitudinal beams 134(*a*), 134(*b*). The lifting motion is done by using pivots 265(*a*), 265(*b*) at the ends of the sliding lifts arms 261(*a*), 261(*b*), respectively, through junction pieces 266(*a*), 266(*b*) to the end of the electric or hydraulic motivator 262. The operation of sliding lift arms 261(*a*), 261(*b*), as driven by the motivator 262 (either electric or hydraulic) is already well known in this art so that no further elaboration is needed for an understanding of the present invention.

Likewise, loading ramps 27(*a*), 27(*b*) are well known in the conventional art as being a necessary attribute for loading caskets (or any similar cargo) onto any number of cargo handling and storing systems, such as those found in the Eekoff, et al. patent. A wide variety of techniques and devices for holding or otherwise handling such ramps are available, and would occur to anyone skilled in this art for application to specific situations in which the casket handling system 10 could be found. One such expedient is found in ramp latches 275.

The benefits of the present inventive casket handling system 10 are obtained in large part from the connected structures of the lower tier 12 and the upper tier 13. In particular, the arranging of rows of caskets on each tier 12, 13 is easily accomplished by the use of two sets of sliding trays 14(*a*), 14(*b*), 16(*a*), 16(*b*) in the front sections 121(*a*), 131(*a*), respectively of each tier 12, 13. The front row section of each tier contains two sets of sliding trays. Each sliding tray is sized to handle a single casket. Two more caskets can be held in the rear sections of both upper and lower tiers 13, 12, respectively.

Both the upper and the lower sliding trays 14(*a*), 14(*b*), 16(*a*), 16(*b*), respectively, are power-driven by tray control and motivating systems 24, 25, respectively, so as to slide over the upper rear decks 15(*a*), 15(*b*), and the lower rear decks 17(*a*), 17(*b*), respectively, so that caskets (not shown) on the sliding trays can be easily accessed from the rear of the casket handling system 10. Likewise, once the sliding trays for both the upper and lower tiers have been moved over the rear decks of either the upper tier or lower tier 12, 13, caskets can be loaded onto the sliding trays, which are then moved to the front sections 121(*a*), 131(*a*) of the upper and lower tiers 13, 12, respectively. Each pair of upper and lower sliding trays, 14(*a*), 14(*b*), 16(*a*), 16(*b*) is moved by a tray control and motivating system 24, 25.

Each of these tray control and motivating systems 24, 25 has sufficient power to move a fully loaded sliding tray 14(*a*), 14(*b*), 16(*a*), 16(*b*), from the front section support frame 121(*a*), 131(*a*) to the rear section support frame 121(*b*), 131(*b*), and back again for both loading and unloading caskets on the casket handling system 10. Each sliding tray is carried on its own set of wheel bearings 20(*a*), (*b*), (*c*), . . . , 21(*a*), (*b*), (*c*), . . . , for the upper and lower sliding trays, respectively. The sliding trays for both the upper and lower tiers 13, 12 slide over upper rear decks 15(*a*), 15(*b*) and lower rear decks 17(*a*), 17(*b*).

The tray control and motivating systems 24, 25 are constituted by electric motors 242, 252 operating worm gear drives 241, 251. Each of these worm gear drives is mounted on a longitudinal median drive beam 137, 127 on each of the upper and lower tiers 13, 12. The lower tier system is relatively simple in that both of the lower sliding trays are driven directly onto the lower rear decks 17(*a*), 17(*b*), which are aligned with the lower bearing wheels 21(*a*), (*b*), (*c*), . . . , so that the lower sliding trays 16(*a*), 16(*b*) move easily onto the lower rear decks, 17(*a*), 17(*b*). Caskets can be loaded directly onto the lower front sliding trays when they are moved to the lower rear decks from the rear of the casket handling system 10. This is especially important when the casket handling system is mounted in a vehicle, thereby limiting access to anything but the rear of the casket handling system.

One advantage of the present invention is the ease of carrying out the processes for loading or unloading caskets. For caskets to be placed on the lower tier 12 the lower front sliding trays 16(*a*), 16(*b*) are moved to the lower rear support frame 121(*b*) and the first caskets are placed thereon. Then the sliding trays are moved to the lower front support frame 121(*a*). This is done easily using the lower tray control and motivating system 25. Because of this capability, it is not necessary for handlers to push caskets in any further than the rear support frame 121(*b*). The casket handling system 10 easily moves the caskets to the lower front support frame 121(*a*) (using tray control and motivating system 25). At this point, it is possible to load two more caskets onto the lower rear decks 17(*a*), 17(*b*). However, if more caskets are to be carried by the subject casket handling system 10, then additional steps need to be taken.

If it is desired to place caskets on upper tier 13, then the upper sliding trays 14(*a*), 14(*b*) are moved back to the upper rear decks 15(*a*), 15(*b*), using the upper tray control and motivating system 24. Then, the upper rear decks 15(*a*), 15(*b*) are tilted downward by activating the deck lift system 26. Once this is done, the sliding arms 261(*a*), 261(*b*) operate responsive to the hydraulic motivator 262 so that they slide in holding tracks 139(*a*), 139(*b*), thereby lowering the rear edge of the upper rear support frame 131(*b*), which contains upper rear decks 15(*a*), 15(*b*) as well as trays 14(*a*), 14(*b*). Then, two caskets can be loaded onto the lowered upper sliding trays 14(*a*), 14(*b*).

Once the caskets (not shown) are on the upper sliding trays 14(*a*), 14(*b*), the deck lift system 26 is again activated in the opposite direction so that the sliding lift arms 261(*a*), 261(*b*) force the rear edge of the upper rear support frame 131(*b*) upwards to a horizontal position. Then the upper tray control and motivating system 24 is once again activated to bring the two upper sliding trays 14(*a*), 14(*b*) back to their original position at the upper front support frame 131(*a*) of the upper tier 13.

The deck lift system 26 can be activated once more to lower the rear edge of the upper rear support frame 131(*b*) so that additional caskets (not shown) can be placed on upper rear decks 15(*a*), 15(*b*). A number of techniques can be used to hold the caskets onto the upper rear decks 15(*a*), 15(*b*) until the upper rear support frame 131(*b*) has been raised to a horizontal position. Afterwards, the last two caskets can be directly loaded onto the rear lower decks 17(*a*), 17(*b*). Then, ramps 27(*a*), 27(*b*) are put in the vertical position to secure the casket handling system 10 for transport.

Unloading the casket handling system follows is very much the same process, in reverse. The loading ramps 27(*a*), 27(*b*) are lowered or deployed so that the caskets (not shown) can be slid down the loading ramps. The caskets or rear lower decks 17(*a*), 17(*b*) are then released from whatever bindings or holding techniques have been applied to keep the caskets in place. Next, the caskets on the lower rear decks 17(*a*), 17(*b*) are removed, by sliding them down loading ramps 27(*a*), 27(*b*). Afterwards, the caskets resting on the lower sliding trays 16(*a*), 16(*b*) on the lower front support frame 121(*a*) can be moved to the lower rear decks 17(*a*), 17(*b*) by operating lower tray control and motivating system 25. After unloading the caskets from the lower sliding trays, 16(*a*), 16(*b*), the upper rear decks 15(*a*), 15(*b*) of upper rear support frame 131(*b*) can be lowered as described supra. The caskets resting on the now lowered upper rear decks 15(*a*), 15(*b*) (on upper rear support frame 131(*b*)) can then be removed.

Next, the upper rear support frame 131(*b*) with its upper rear decks 15(*a*), 15(*b*) is once again raised to the horizontal position using deck lift system 26. Then, the upper sliding trays 14(*a*), 14(*b*) are moved rearwards by means of upper tray control and motivating system 24. Once the upper sliding trays 14(*a*), 14(*b*) have moved their caskets to the upper rear decks 15(*a*), 15(*b*), the upper rear support frame 131(*b*) can then be lower as described supra. The caskets on the upper sliding trays 14(*a*), 14(*b*), which have been moved to the upper rear decks 15(*a*), 15(*b*) can then be slid off of those rear decks, and off of the casket handling system via loading ramps 27(*a*), 27(*b*).

Because the upper sliding trays 14(*a*), 14(*b*) are expected to tilt with the upper rear decks 15(*a*), 15(*b*), a special connection must be made between the upper tray control and motivating system 24, and the upper front sliding trays 14(*a*), 14(*b*). In particular, connection must be maintained with the upper tray control and motivating system 24 when the upper sliding trays 14(*a*), 14(*b*) are tilted downward after being moved to the upper rear decks 15(*a*), 15(*b*). A double pivot structure 243 connects the end of the gear drive 241 to an upper median longitudinal beam 137 between the two upper front sliding trays 14(*a*), 14(*b*). The double pivot structure 243 permits sufficient flexing between the stationary front upper median longitudinal beam 137 and a longitudinal junction beam 14(*c*) (depicted in FIG. 2) connecting the two upper front sliding trays 14(*a*),14(*b*).

Figures 6A, 6B, 6C:
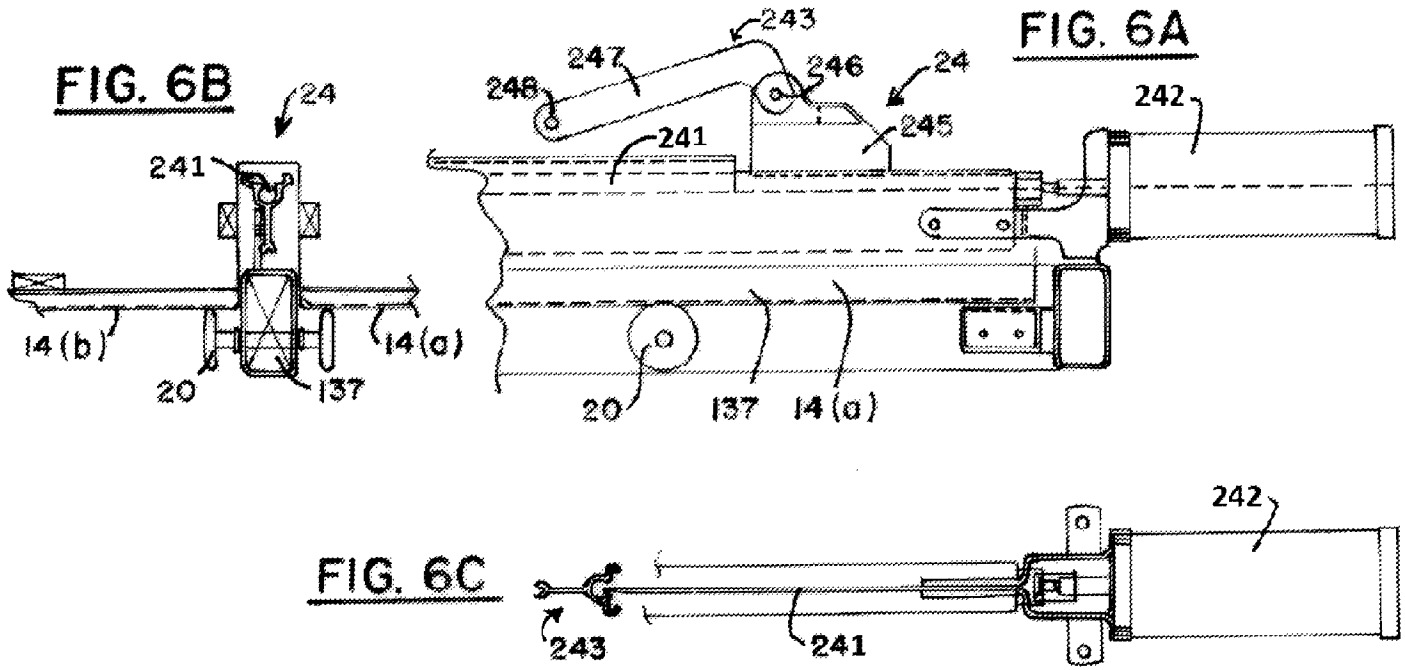
FIG. 6A is a side view of the sliding tray transport system.
FIG. 6B is a side view of the sliding tray transport system.
FIG. 6C is a top sectional view of the sliding tray transport system.

FIGS. 6A, 6B and 6C depict the connection arrangement between the upper motivating system 24 and the upper sliding trays 14(*a*), 14(*b*). The double pivot structure 243 includes carriage 245, which is attached to worm gear drive 241. The double pivot arrangement includes a first pivot 246 on carriage 245 connecting arms 247 to the trays 14(*a*), 14(*b*) using pivot 248 connected to the sliding trays 14(*a*), 14(*b*) by a pivot point 258 (seen in FIG. 9). The use of the double pivot structure 243 permits connection to be maintained to the sliding trays 14(*a*), 14(*b*) when the upper rear support frame 131(*b*) is tilted without causing disconnection between the upper trays 14(*a*), 14(*b*) and the upper tray control motivating system 24.

The tilting of the upper rear support frame 131(*b*) (either with or without upper sliding trays 14(*a*), 14(*b*) on upper rear decks 15(*a*), 15(*b*)) is done by virtue of lateral pivot beam 136. Individual pivots 135(*a*), 135(*b*), 135(*c*) are formed as part of lateral pivot beam 136. Complementary pivot structures (not shown) are formed on the upper rear decks 15(*a*), 15(*b*) (i.e., formed together as a unitary structure by virtue of longitudinal junction beam 15(*c*)). The complementary pivot structures on the unitary rear decks 15(*a*), 15(*b*) interface with the pivot structures on the lateral pivot beam 136 in a common, mechanical pivot arrangement. A wide variety of different conventional pivot structures can be used at this point in the casket handling system 10, and can be selected by the manufacturer in a manner which best fits the size and loading characteristics for the casket handling system 10.

Figure 5:
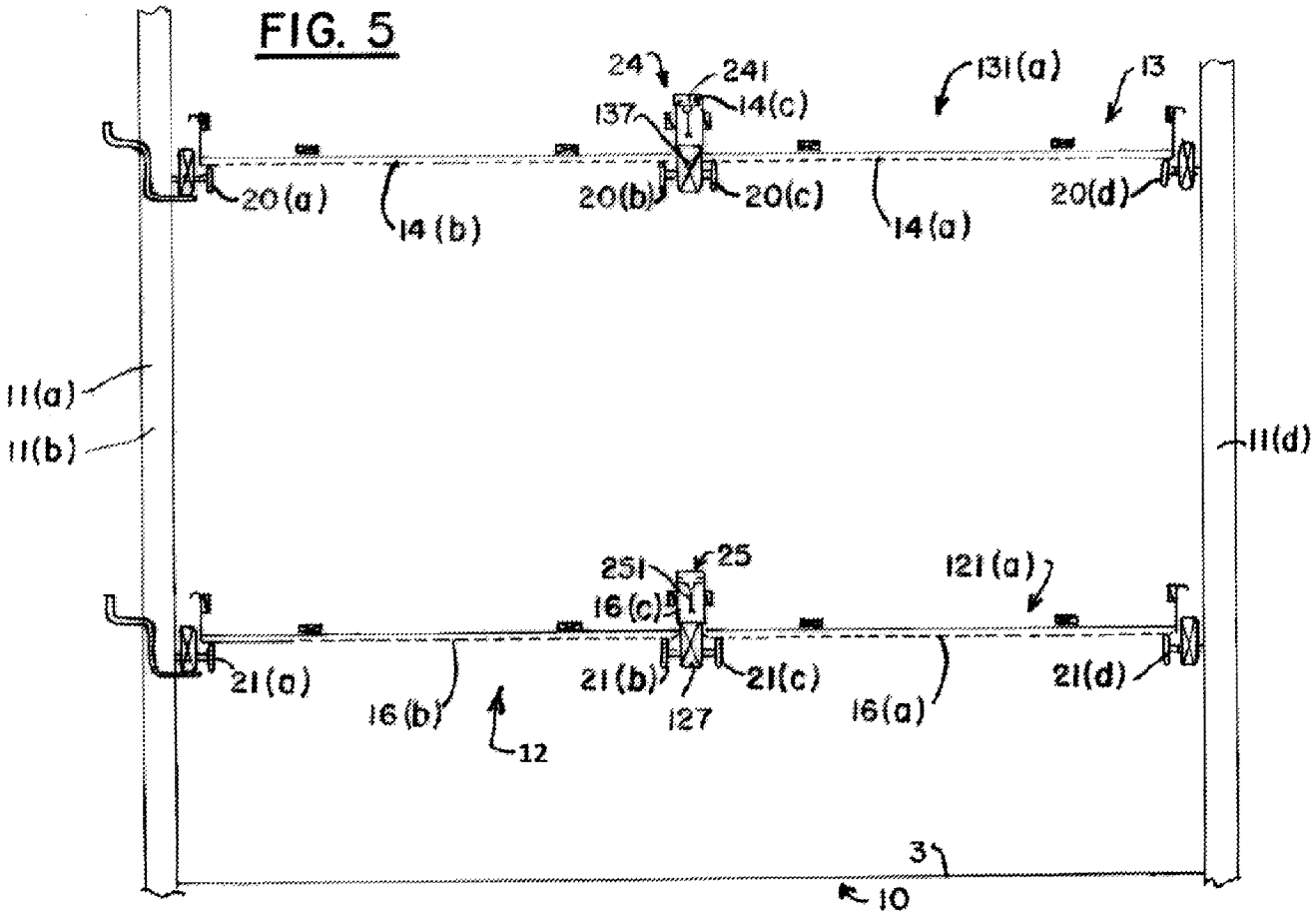
FIG. 5 is a front sectional view of the present invention depicting the sliding tray structure within the overall upper and lower tier support frames.

An end view of tray control and motivating systems 24, 25 for both the upper and lower sliding trays 14(*a*), 14(*b*), 16(*a*), 16(*b*) are depicted in FIG. 5. The figure is a detailed sectional view depicting cross-sections of the upper and lower sliding trays and the two median longitudinal drive beams 137, 127 that support the worm drives 241, 251 of the respective drive systems. The longitudinal junction beams 14(*c*), 16(*c*) are used to connect the two sets of trays to each other. The worm gears 241, 251 drive the unitary combined sliding tray structures together as one piece using roller bearings 20(*a*) . . . and 21(*a*) . . . to support the sliding trays.

Figure 10:
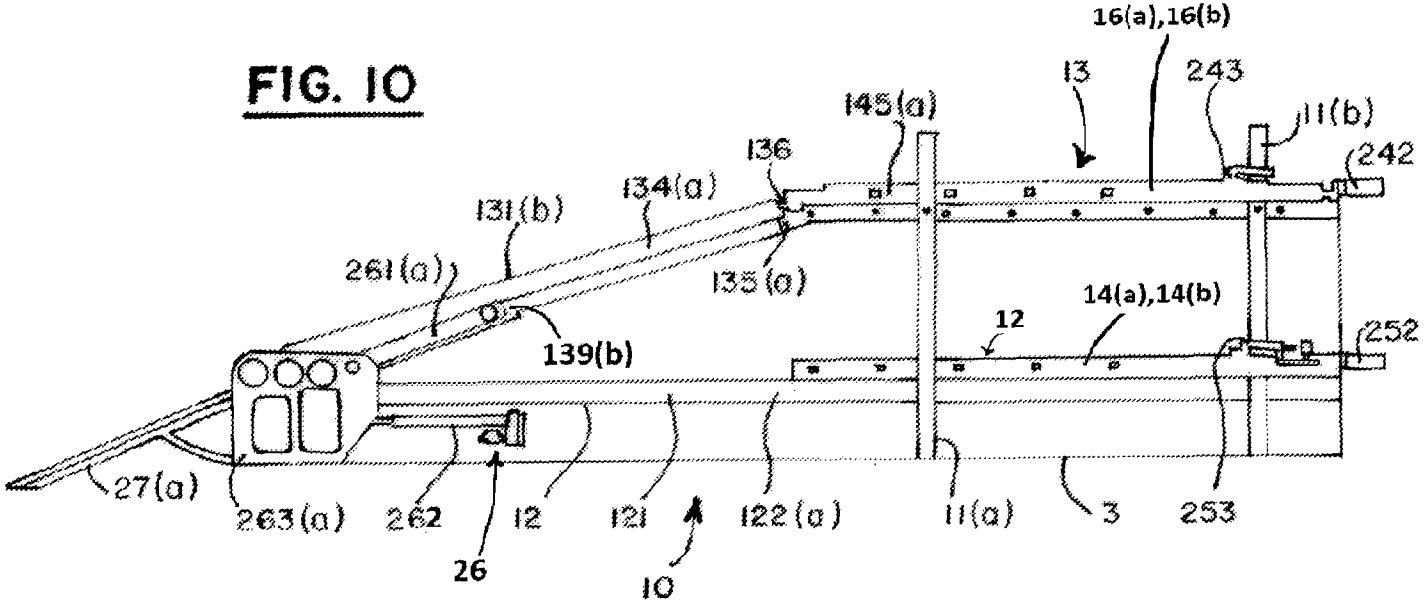
FIG. 10 is a side view of the present invention deployed for adding or removing caskets, and in which the upper and lower sliding trays are in the forward position in the upper front row section and the lower front row sections, respectively.

FIG. 10 is a side view depicting the casket handling system 10 of the present invention in a deployed position for loading or unloading of caskets. This figure depicts a number of key attributes of the present invention, including the lower tier 12 structure of continuous parallel longitudinal beams 122(*a*), 122(*b*). Once feature is the location of the double pivot structure 243 for connecting the tray drive system (worm drive 241 and motor 242) to the upper trays 14(*a*), 14(*b*). The specific arrangement for permitting the subject sliding trays to tilt with the upper rear support frame 131(*b*) has been described supra. This functionality is not necessary on the lower tier 12 trays 16(*a*), 16(*b*) since these trays do not have to tilt. Accordingly, even though a similar connection (double pivot structure 253) is shown between the tray control and motivating system (motor 252 and worm gear 251) and the sliding trays 16(*a*), 16(*b*), on the lower tier 12, this pivoting structure is not necessary. Rather any technique for connecting the sliding trays 16(*a*), 16(*b*) to the lower work drive 251 will be acceptable for purposes of the present invention.

FIG. 10 also depicts the relationship of both sets of sliding trays 14(*a*), 14(*b*), 16(*a*), 16(*b*) on upper and lower tiers 13, 12, respectively. In this view, the upper and lower trays are shown in the forward position (i.e., located at the front or forward sections of their respective tiers). From this depiction it should be clear that both the upper and lower support frames 131, 121, respectively, are constituted by parallel beams that contain the respective decks and sliding trays. The sliding trays may have sidewalls, such as 145(*a*) (depicted in FIG. 11), which extend vertically above the height of the beam walls of the respective support frames 131, 121. The key structures for the upper and lower rear support frames 121(*b*), 131(*b*) are the decks 15(*a*), 15(*b*) and 17(*a*), 17(*b*), previously described. Both decks can have sidewalls to help contain and align the movement for the respective sliding trays 14(*a*), 14(*b*), 16(*a*), 16(*b*).

Figure 9:
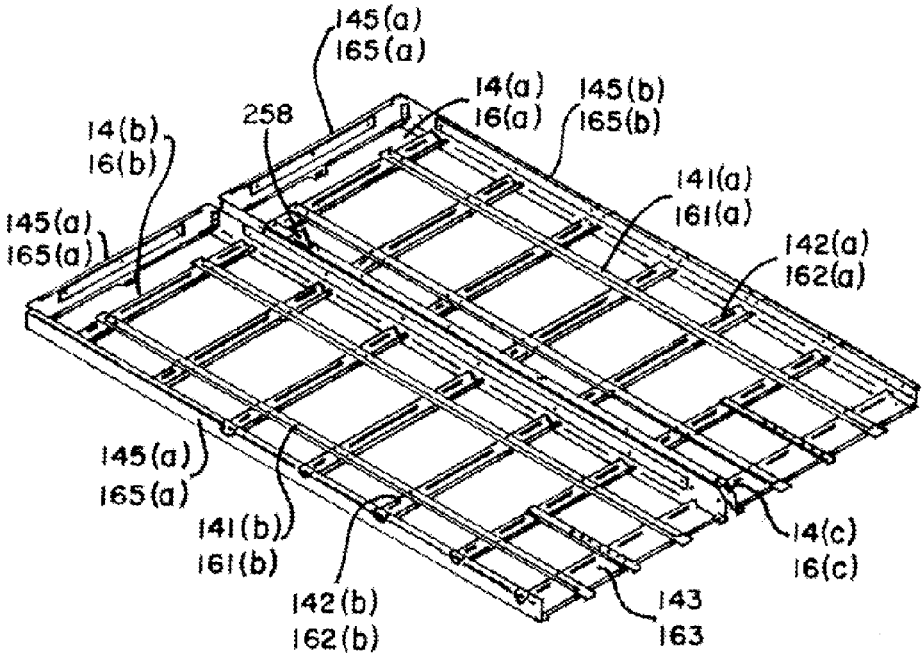
FIG. 9 is a top perspective view of the upper and lower sliding trays.

It should be noted that while the structure of sliding trays 14(*a*), 14(*b*), 16(*a*), 16(*b*), as described and depicted in FIG. 9, is the preferred embodiment of the present invention, it is only one embodiment. In the alternative, structures besides the cross-struts depicted in FIG. 9 can be used to constitute the sliding trays. For example, the sliding trays can be an entirely continuous surface, and made of materials other than the metallic struts used in the first preferred embodiment. The important attribute here is that the trays are capable of holding the caskets (or other cargo) without damaging them, and that the trays slide easily from the front sections to the rear sections of the casket handling system 10.

Likewise, the upper and lower rear decks 15(*a*), 15(*b*), 17(*a*), 17(*b*) need not be the same as the structure depicted in FIGS. 7 and 8. Rather, any structure that adequately accommodates fully loaded sliding trays would be acceptable for purposes of the present invention. However, it has been discovered that the particular arrangement for the upper decks 15(*a*), 15(*b*) as depicted in FIG. 7, is particularly effective in the handling of both sliding trays and caskets. Further, the particular arrangement depicted in FIG. 7 helps facilitate the pivoting of the entire upper rear deck structure 131(*b*) from the upper front support frame 131(*a*) of the upper tier 13. Without this mid-tier pivoting function, this embodiment of the present invention could not operate as it does.

The deck lift system 26 is necessary for allowing the upper rear support frame 131(*b*) to tilt down to the positions depicting in FIGS. 10 and 11. However, the present invention is not limited to this particular configuration for the deck lifting system. Rather, other arrangements could be used, such as different configurations of hydraulic arms, mechanical jacks, and the like.

There are a wide variety of different structures that can be used for the various parts of the overall casket handling system 10. Drawings 1-17 depict two basic embodiments. However, other embodiments are possible, and there are many variations within each embodiment, or exchangeable between the two embodiments, within the basic concept of the present invention.

One example of an arrangement that can be used in the first embodiment of the present invention, is the upper rear deck structure 15(*a*), 15(*b*), depicted in FIG. 7. Both decks 15(*a*) and 15(*b*) are separated by a longitudinal junction beam 15(*c*). Both decks are formed with longitudinal struts 151(*a*), 151(*b*). These are attached to lateral perpendicular struts 152(*a*), 152(*b*). The entire structure is supported by longitudinal beams 132(*a*), 132(*b*), constituting part of the periphery of the upper support frame 131(*b*).

Because the structure in FIG. 7 must tilt from the upper tier 13 level down to the lower tier 12 level, additional bracing may be necessary. This is provided by plate 153, across the distal end of the combined upper rear decks 15(*a*), 15(*b*). This extra support is necessary to accommodate the movement of heavy caskets off the edge of the two decks, and down slide extensions 151(*c*) to the loading ramps 27(*a*), 27(*b*).

The reinforced structure of the upper rear decks 15(*a*), 15(*b*) is not necessary for the upper front portion of the upper support frame 131(*a*). As depicted in FIG. 4, there is no structure within the peripheral longitudinal beams 132(*a*), 132(*b*). The upper sliding trays 14(*a*), 14(*b*) are supported only by roller bearings 20(*a, b, . . .*). This arrangement is the same for the front lower support frame 121(*a*).

The lower rear decks 17(*a*), 17(*b*) are depicted in FIG. 8. Structurally, these are very similar to the upper rear deck in many respects. For example, there is a longitudinal medium beam 17(*c*). There are longitudinal struts 171(*a*), 171(*b*), which are connected to perpendicular lateral struts 172(*a*), 172(*b*). The combined deck structure is part of the rear lower support frame 121(*b*). Continuous, longitudinal support beams 122(*a*), 122 (*b*) support the rear section 121(*b*), as well as the front section 121(*a*).

It should be noted that the structural arrangements of FIGS. 7 and 8 are merely exemplary. Any arrangement that provides the necessary structural integrity could be used in place of these two arrangements. Likewise, such arrangements could be used in the front sections 121(*a*), 131(*a*) instead of the open arrangement depicted in FIG. 4. For example, a flat contiguous solid, surface or bed could be arranged on either of the support structures of FIG. 7 or FIG. 8 in order to provide a solid, supported bed. Further, such structures could also be used in front sections 121(*a*), 131(*a*) of the support frames of each tier 12, 13 of the casket handling system 10.

FIG. 9 depicts an example of the double upper and lower sliding trays 14(*a*), 14(*b*), 16(*a*), 16(*b*). Both the upper and lower sliding tray pairs are identical in this particular embodiment. This is indicated by the double drawing designation numerals associated with each of the elements in the drawing. Each sliding tray 14(*a*), 14(*b*), 16(*a*), 16(*b*) includes peripheral support structure sidewalls 145(*a*), 145(*b*), 165(*a*), 165(*b*), which helps ensure a unified double tray arrangement capable of handling the weight of two caskets (not shown). The deck structures are reinforced by longitudinal struts 141(*a*), 141(*b*), 161(*a*), 161(*b*) and perpendicular or lateral struts 142(*a*), 142(*b*), 162(*a*), 162(*b*). Further support is provided by bottom plate 143, 163 located at the end of the combined tray structure. It should be noted that while the sliding tray structure of FIG. 9 is an open framework, a solid contiguous surface can be arranged across the depicted framework as another variation of the present invention.

A solid surface for the trays or the decks is useful in preventing debris from the caskets or other load (not shown) from dropping upon lower tier 12 or the deck lifting system 26 beneath the lower tier 12. A flat sheet of material across the bottom of the sliding trays could also provide a great deal of additional stability to the sliding trays. Likewise, the side walls 145(*a*), 145(*b*), 165(*a*), 165(*b*) on the sliding trays can be modified, along with the median longitudinal beam 14(*c*), 16(*c*) to provide the desired level of structural strength.

Other modifications within the concept of the present invention can be found in the deck lifting system 26 for raising and lowering the combined rear upper decks 15(*a*), 15(*b*). FIGS. 10 and 11 depict one version of the deck lifting system 26. The deck lifting system 26 consists of a hydraulic motivator (piston system) 262 to drive sliding lift arms 261(*a*), 261(*b*) through junction pieces 266(*a*), 266(*b*) (connected to the sliding lift arms at pivots 265(*a*), 265(*b*)) to lift the distal or rear end of upper rear decks 15(*a*), 15(*b*). The interface with the subject decks is through sliding interface structures 139(*a*), 139(*b*) (depicted in FIG. 7). It should be noted that the other motivators (besides hydraulic pistons) can be used to raise and lower the upper rear section of support frame 131(*b*).

In FIG. 11, loading ramps 27(*a*), 27(*b*) are held in position by latch structures 275. However, any number of different arrangements can be made to secure the loading ramps in both the deployed and retracted positions. For example, the depicted support frames 263(*a*), 263(*b*), which cooperate with the latch structures, can be replaced by equivalent structures.

FIGS. 12-17 depict a second embodiment of the present invention. In this embodiment, the upper tier 13 is not hinged so that the rear portion can be tilted downward. Rather, the entire upper tier is a single rigid structure (like the lower tier 12), and is lowered or raised as a single unit. In the second embodiment, this is accomplished through the use of a multiple pulley system raising and lowering the upper tier as a single unit at multiple points. This is accomplished through multiple pulley systems contained in vertical supports, which are constituted by tubular metal supports. These supports are configured to support both tiers as a stable structural unit, and to contain various parts of the pulley system.

The second embodiment depicted in FIGS. 12-17 discloses upper decks 41, 42 and lower decks 51, 52 as being constituted by solid surfaces, supported or reinforced by ribs 43, 53, respectively. However, while the solid surfaces for the decks can be helpful, it is not absolutely necessary. This is especially true in view of the option of providing solid surfaces to constitute the upper and lower sliding trays 14(*a*), 14(*b*), 16(*a*), 16(*b*). Further, while longitudinal support ribs 43, 53 are depicted, any support frame or arrangement, such as those depicted in FIGS. 7 and 8, can also be used, both with and without a solid surface or bed for any of the decks or the sliding trays. The structures selected can be configured in any manner appropriate to support the expected weights for the caskets or other loads to be handled.

Figure 17:
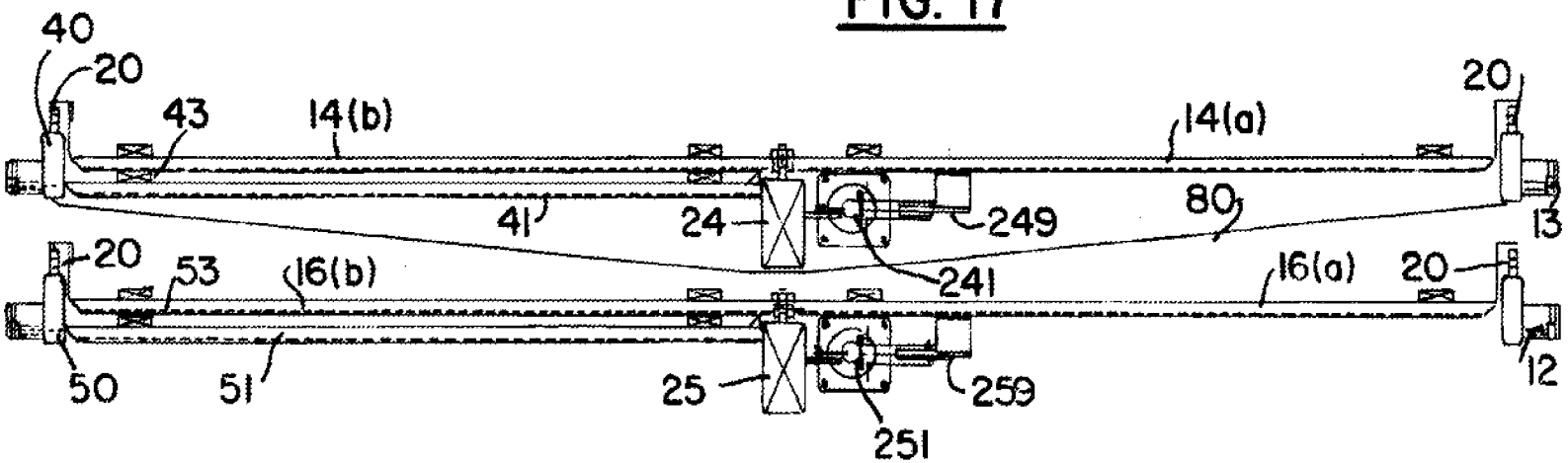
FIG. 17 is an end view of the second embodiment, depicting the edges of both the movable drawers and the underlying decks.

For example, in FIG. 17, the sliding trays 14(*a*)(*b*), 16(*a*)(*b*) of both the upper and lower tiers 13, 12 have solid contiguous surfaces. Likewise, the decks 15(*a*), 17(*a*), beneath the sliding trays can also be provided with solid surfaces. The surfaces are provided with longitudinal reinforcing struts 43, 53, respectively. A double solid surface, such as those depicted in FIG. 17, can be particularly helpful to prevent problems that might be caused by leakage from the cargo being handled.

It should be understood that while the present system 10 is particularly effective for caskets, a wide variety of different types of loads can be handled effectively. Unlike the first embodiments, as depicted in FIGS. 1-11, the vertical supports 30 are situated uniformly along the two longitudinal sides of the casket handling system 10. This provides a great deal of stability to the overall structure in which the upper tier 13 is surrounded by the peripheral support structure 40 and the lower tier 12 is surrounded by peripheral support structure 50. Both peripheral support structures are connected securely to the vertical supports 30. Also fastened or formed securely to the supports are secondary vertical supports 31 that extend beneath the lower tier 12.

Figure 14:
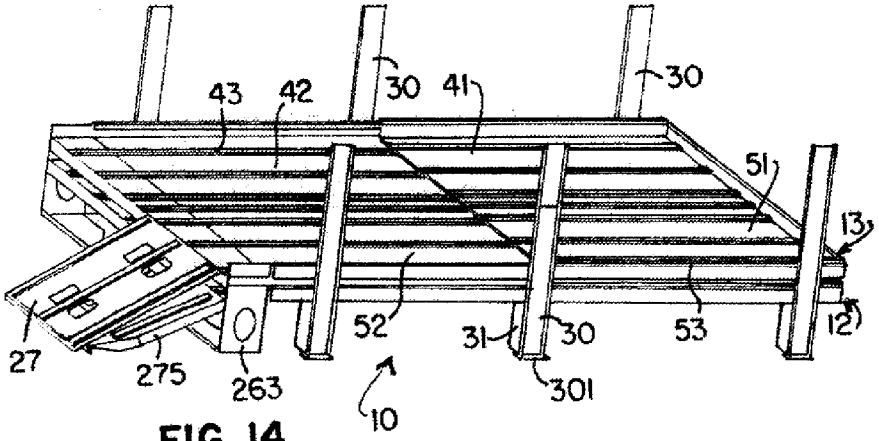
FIG. 14 is a perspective view of the second embodiment with the loading ramp deployed and the upper tier lowered for loading or unloading of caskets.
Figure 16:
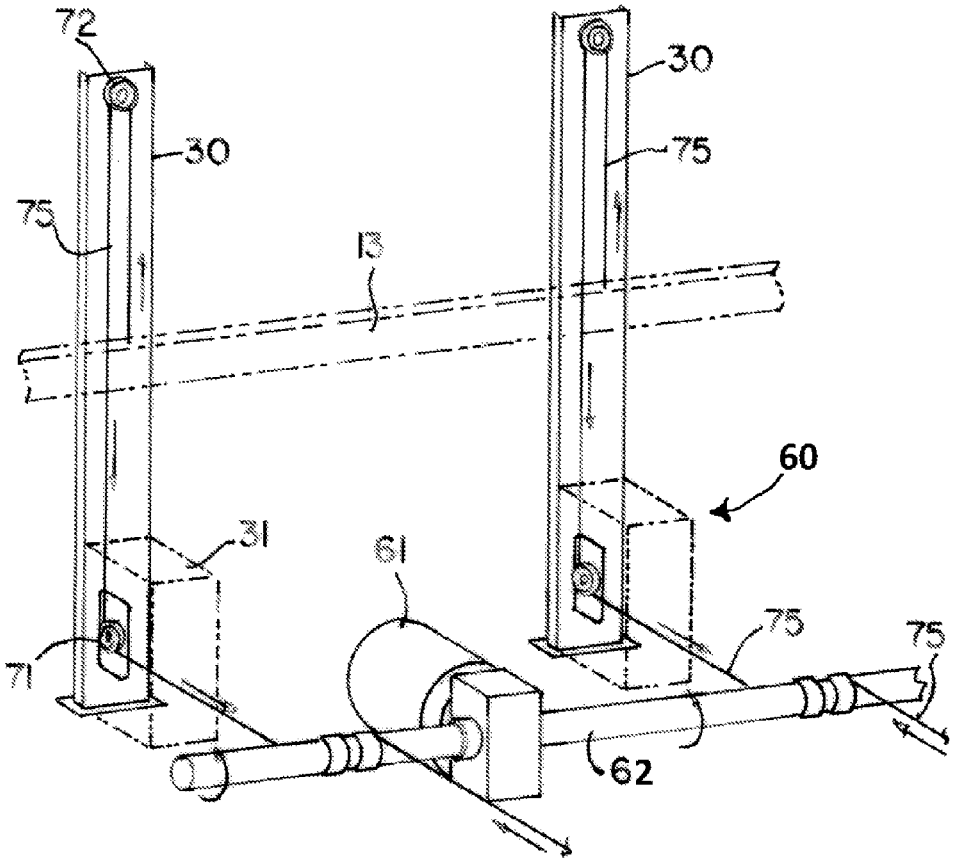
FIG. 16 is a cut away detailed view of the motivating system for raising and lowering the upper tier.

A key requirement for vertical supports 30 is that they be sized to contain the cable and pulley system depicted in FIG. 16. The pulley system is capable of raising and lowering the upper tier 13 as an entirety so that it will rest either on or closely above the lowered tier 12, as depicted in FIG. 14. All six vertical supports 30 provide lifting mechanisms so that the upper tier 13 can be raised and lowered evenly. It should be noted that the overall casket handling system 10 is arranged so that when the upper tier 13 is lowered, the edge of the upper tier is positioned so as to provide a path whereby the casket (or other cargo) can slide easily from the upper tier 13 to loading ramp 27, without a substantial drop or discontinuity in the overall travel path of the cargo. The final position of the lowered upper tier 13 can be controlled by retaining line 80.

Figure 12:
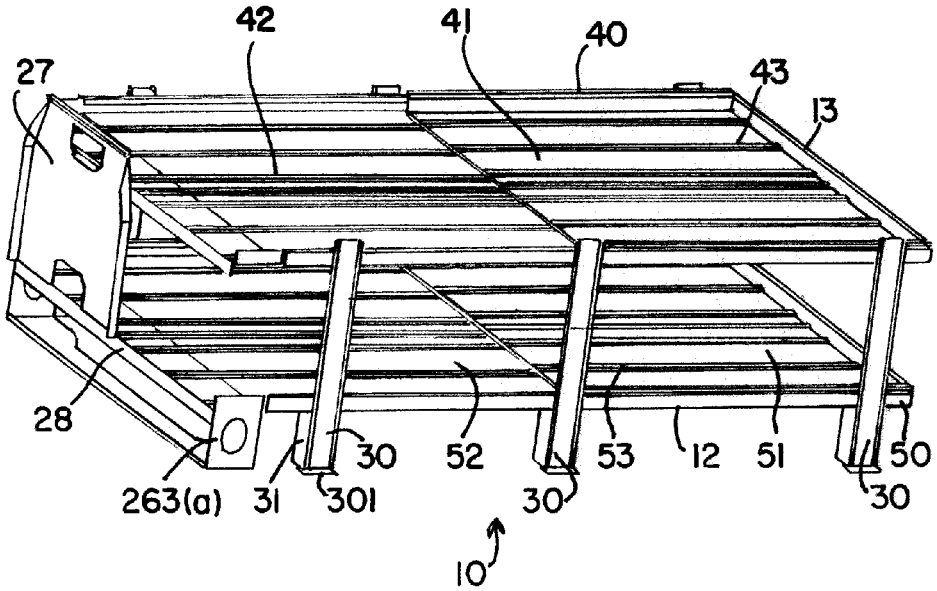
FIG. 12 is a perspective view of a second embodiment of the present invention with the loading ramp retracted.
Figure 13:
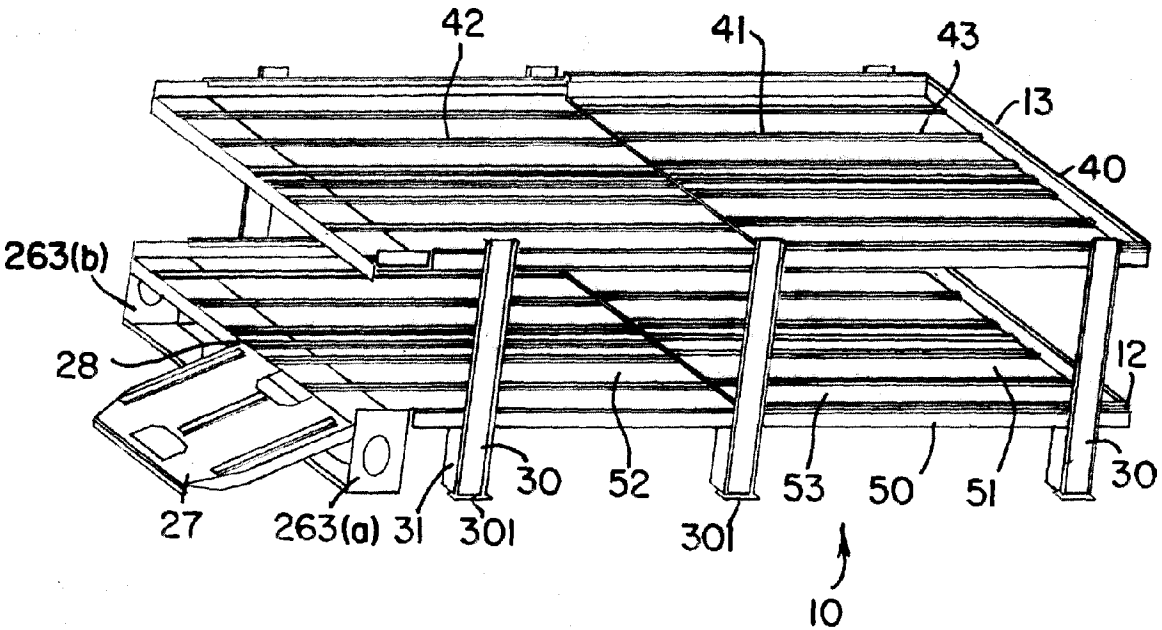
FIG. 13 is a perspective view of the second embodiment with the loading ramp deployed.

Two loading ramps 27(*a*), 27(*b*) can be provided as is depicted in FIGS. 1-11. However, only a single loading ramp 27 is depicted in the second embodiment (FIGS. 12-17). The single loading ramp 27 is moved from side to side as needed by virtue of slide mount system 28. As with the first embodiment, the loading ramp 27 can be positioned firmly in place using latching system 275, which interfaces with support frames 263(*a*), 263(*b*) on either side of the system 10. The loading ramp 27 can be moved in the raised position, as depicted in FIG. 12, to the opposite side of the system 10 and then lowered as depicted in FIG. 13.

Figure 15:
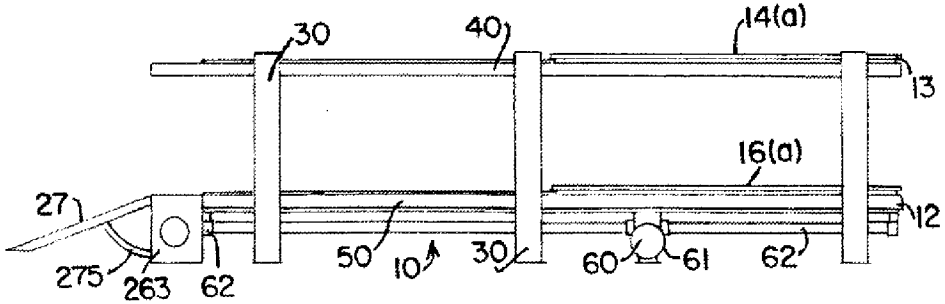
FIG. 15 is a side view of the second embodiment, depicting the motivating system for lowering and raising the upper tier.

FIG. 15 is a side view with a raised upper tier 13 and a deployed loading ramp 27. This figure depicts the power source 61 for the lifting system 60 for upper tier 13. The power source 61 is preferably an electric motor activating a power winching system which uses an extended reel 62 to control lifting cables 75, as depicted in FIG. 16. Cables 75 are uniformly driven, using extended reel 62 to uniformly lift the upper tier 13 at six different points, using pulleys 71, 72 contained within the subject vertical supports 30. The connections (not shown) between the lifting cables 75 and the upper tier 13 can be of any type appropriate for the weight and location of the upper tier 13 and its load (not shown).

It should be understood that any number of different hybrids of the first and second embodiments can also be used. This would entail a hinged upper tier 13 that would be operated to tilt downward (as is done in the first embodiment) using the lifting cable and extended reel (driven by motor 61) to control raising and lowering of the rear upper decks 15(*a*), (*b*). While this arrangement is not depicted in the drawings, one skilled in this particular art could arrange such a system based upon the teachings of the two separate embodiments.

The motivating or power system 60 for the second embodiment is substantially different than that used for the first embodiment, as depicted in FIGS. 1-11. FIG. 16 depicts the motivating system 60 for raising and lowering the upper tier 13. The view of FIG. 16 is from within the casket handling system 10, directed outwards to the upper peripheral support frame 40. The entirety of tier 13 is raised or lowered by a plurality of lifting cables 75. These cables are mounted using pulleys 71, 72, and are moved by extended reel 62 on which the lifting cables 75 are wound.

The extended reel 62 is powered by an electric motor 61. The plurality of lifting cables 75 are wound on the extended reel so that rotation of the reel serves to simultaneously move the lifting cables at all three vertical supports. As a result the entirety of upper tier 13 is raised or lowered equally over its entire extent. Pulleys 72 are contained within the upper portion of the hollow tubular vertical supports 30. Pulleys 71 are contained in the secondary supports 31, which also help support the lower tier 12. Each end of the multiple lifting cable 75 is attached to the upper tier at its respective tubular vertical support 30. This attachment can be carried out using any number of different techniques well known in the connection art.

The electric motor 61 can be sized for the expected load to be carried by the upper tier 13. Likewise, the gearing system between motor 61 and extended reel 62 can also be designed for a specific load, whether it be caskets or some other type of material. Likewise, the pulleys 71, 72 can be configured within hollow tubular vertical supports 30 in a manner appropriate for the size of the load to be raised and lowered on upper tier 13.

It should be understood that while the depicted embodiment includes an electric motor 61 powering multiple lifting cable 75, other power sources can be used. For example, multiple hydraulic jacks can be used to raise and lower upper tier 13. Also, a pneumatic system can be used to raise and lower upper tier 13. The type of power system would be dependent on the total loads, environment, and the long term duty cycles expected of the system 10.

The differences in the power lifting system 60 can be used to accommodate and support different arrangement for the overall structure of the upper tier 13 and upper sliding trays 14(*a*), 14(*b*). The arrangement of the sectional end view depicted by FIG. 17 for the second embodiment is somewhat different than that depicted in FIG. 5 for the first embodiment. However, the basic concepts are the same, and should be considered only as variations of each other.

In FIG. 17, a longitudinal junction beam 24 is used to guide the drive system for both of the sliding trays 14(*a*), 14(*b*). The same arrangement is also found for the lower tier 12. The trays for both tiers 12, 13 slide on the upper and lower longitudinal junction beams 24, 25, respectively. The ends of the sliding trays are supported by the upper peripheral framework 40 and the lower peripheral framework 50. All sliding trays (both upper and lower) slide on wheel bushings 20. It is noted that the motivating systems in FIG. 5 (first embodiment) are arranged above and in line with the longitudinal junction beams 127, 137, respectively. In contrast, the motivating system of the FIG. 17 embodiment (including a motor and a worm gear) is offset to the side. The connection between the worm gear 241 and the trays 14(*a*), 14(*b*) which are coupled to each other is effected by linkage assembly 249. The same is done on the lower tier 12 through linkage 259. The linkage 249 is very similar to the arrangement found in FIG. 6(*a*) except that there is a lateral offset rather than a vertical offset. It should be noted that the arrangement of FIG. 17 does not accommodate the tipping of the upper rear deck found in the first embodiment.

Because of the front and rear sections of upper tier 13 the upper decks do not tilt with respect to each other, a solid contiguous surface can be arranged over both the front sections and the rear sections. FIG. 17 depicts trays having solid contiguous surfaces reinforced with longitudinal beams 43, 53 for bracing.

It is clear that alternative embodiments of the present invention are not only possible, but should be facilitated based upon various environments in which the present invention can be placed. Accordingly, the present invention should be understood to include any and all variations, modifications, permutations, adaptations, derivations and embodiments that would occur to one skilled in this art having possession of the teachings of the present invention. Therefore, the present invention should be construed to be limited only by the following claims.

We claim:

1. A multi-tiered casket handling system having an accessible, adjustable rear section and a fixed front section, each said front section and each said rear section comprising at least one upper tier and one lower tier, each said tier accommodating at least two rows having capacity for at least two caskets in each said row, said casket handling system further comprising:

a) at least two movable trays supported on roller bearings, said trays positioned at the upper and lower tiers in the front section arranged for transporting caskets back and forth between said front section and said rear section;

b) a first powered transport system for moving said upper tier tray in the front section between said front section and said rear section of said upper tier;

c) a powered pivot structure attaching said upper tier of the rear section to a fixed frame of said upper tier to the front section, wherein the entire rear section of the upper tier rotates downward with respect to said fixed frame of the front section of the upper tier; and, d) a hinged structure pivotally connecting said movable tray on said upper tier of the front section to said first powered transport system.

2. The multi-tiered casket handling system of claim 1, further comprising:

a second powered transport system for moving said lower tier tray in the front section between said front section and said rear section of said lower tier.

3. The multi-tiered casket handling system of claim 2, wherein each of said first and second powered transport systems comprises an electric motor and a worm gear.

4. The multi-tiered casket handling system of claim 3, wherein said powered pivot structure tilts said rear section of said upper tier toward said rear section of the lower tier when said upper tier tray of the front section has been moved by the first powered transport system from said front section to said rear section of said upper tier.

5. The multi-tiered casket handling system of claim 4 further comprising:

an adjustable ramp system arranged to connect said lower tier of said rear section to an external substrate.

6. The multi-tiered casket handling system of claim 5, wherein said adjustable ramp system is arranged to move from a retracted position to a lowered position against said substrate by a latch.

7. A multi-tiered casket handling system of claim 6, wherein said powered pivot structure is adjustable to tilt said upper tier of said rear section providing a pathway from said upper tier to said substrate when said rear section of said upper tier and said adjustable ramp system are in lowered positions.

8. The multi-tiered casket handling system of claim 7, wherein said multi-tiered casket handling system is configured for mounting in a vehicle.

9. The multi-tiered casket handling system of claim 8, further comprising a support system arranged to connect said upper tier and said lower tier to an interior of said vehicle.

10. The multi-tiered casket handling system of claim 9, wherein said support system comprises a plurality of vertical supports configured to maintain a predetermined distance between said upper tier and said lower tier, and to connect said multi-tiered casket handling system to interior structures of said vehicle.

11. The multi-tiered casket handling system of claim 10, wherein said vertical supports connect said upper tier and said lower tier with a floor structure of said vehicle.

12. The multi-tiered casket handling system of claim 11, wherein said vertical supports are positioned on a front and two sides of the front section of said upper tier and said lower tier.

13. The multi-tiered casket handling system of claim 4, wherein said powered pivot structure is motivated at least in part by operation of a pulley structure.

14. A method of handling caskets on a multi-tiered casket handling and storage device having upper and lower tiers, each said tier having front and rear sections, said method comprising steps:

a) placing a first casket on a rear section of said lower tier;

b) operating a first motorized tray system to move said first casket between said rear section and said front section of said lower tier;

c) operating a powered pivoting system to tilt said rear section of said upper tier and a second motorized tray connected by a hinged structure to said front section of said upper tier, downward towards said rear section of said lower tier;

d) placing a second casket on said tilted rear section of said upper tier;

e) operating said powered pivoting system to raise said tilted rear section of said upper tier with said casket; and, f) operating a second motorized tray system to move said second casket from said rear section to said front section of the upper tier.

15. The method of claim 14, wherein a hinged structure pivotally connects a powered transport drive to a movable tray of the second motorized tray system when said rear section of said upper tier is tilted towards said lower tier.

16. The method of claim 15, wherein said upper tier is raised and lowered by operation of a plurality of pulley structures.

* * * * *